US010259556B2

(12) United States Patent
Asfar

(10) Patent No.: US 10,259,556 B2
(45) Date of Patent: Apr. 16, 2019

(54) MARINE VEHICLE ENGINE

(71) Applicant: Jordan University of Science and Technology, Irbid (JO)

(72) Inventor: Khaled Rafiq Asfar, Irbid (JO)

(73) Assignee: Jordan University of Science and Technology, Irbid (JO)

( * ) Notice: Subject to any disclaimer, the term of this patent is extended or adjusted under 35 U.S.C. 154(b) by 549 days.

(21) Appl. No.: 15/097,499

(22) Filed: Apr. 13, 2016

(65) Prior Publication Data

US 2017/0297670 A1 Oct. 19, 2017

(51) Int. Cl.
*F02B 75/00* (2006.01)
*B63H 23/26* (2006.01)
*B63H 5/00* (2006.01)

(52) U.S. Cl.
CPC ..... *B63H 23/26* (2013.01); *B63H 5/00* (2013.01)

(58) Field of Classification Search
CPC . B63H 23/26; B63H 5/00; F02B 61/00; F02B 5/02
See application file for complete search history.

(56) References Cited

U.S. PATENT DOCUMENTS 5,421,153 A * 6/1995 Schleicher ..... B63H 11/16 440/44
2011/0259257 A1* 10/2011 Costas ..... B63B 1/38 114/289

* cited by examiner

*Primary Examiner* — Hung Q Nguyen
(74) *Attorney, Agent, or Firm* — Kelly Kordzik, Esq.; Matheson Keys & Kordzik PLLC

(57) ABSTRACT

A marine vessel engine in which moving parts found in conventional marine engines are eliminated, wherein such engine is used for the propulsion of marine vessels. In the marine vessel engine, no lubrication or cooling is required, and a column of water replaces the conventional piston in a cylinder of the engine, wherein such water column partially fills such cylinder. The marine vessel engine comprises a cylinder, a bent tube with a plurality of openings and two ends, a flapping member, at least one solenoid valve, and an exhaust. In operation of the marine vessel engine, a column of water fills the cylinder through the bent tube openings, and is purged outside from the cylinder through the flapping member. The at least one solenoid valve controls the flow of a power source into the cylinder.

20 Claims, 12 Drawing Sheets

MARINE VEHICLE ENGINE

TECHNICAL FIELD

The present invention relates in general to marine vessel engines that are used for the propulsion of marine vessels, and more particularly to, marine vessel engines that do not have metallic moving parts.

BACKGROUND INFORMATION

Numerous solutions disclose various propulsors and pumps for marine vessels. Among these solutions, there is provided a propulsor having a body secured in a fairing for reciprocating motion of a working member mounted on a rod of a drive. Drive is produced in a form of a hydraulic cylinder, and a piston-blade is used as a working member for performing motion in the cylinder, which is secured in a propulsor body by means of struts at clearance between body and cylinder forming a nozzle directed to a side opposite to the fairing, thus creating thrust for motion of the water craft at a forward stroke of the piston-blade due to displacement of water from the cylinder at simultaneous filling space between fairing and piston-blade through nozzle and clearance between cylinder and body with water due to hydrostatic pressure and pressure of the piston-blade. At a reverse stroke of the piston-blade, water is displaced from the cylinder between the fairing and the piston-blade through clearance and nozzle, thus also creating thrust for motion of the water craft.

Another solution provides a liquid piston pump for liquids and gases, which may replace the classic diaphragm pumps and the piston pumps, which are used for small and medium flow rates, the liquid piston pump being used especially for replacing the duplex horizontal pumps for a water supply due to the increase of the self-priming parameter and implicitly for a higher safety during operation. The pump comprises a mechanical diaphragm pump or a piston pump provided with a coaxial distribution assembly in two embodiments: one with peripheral suction and central discharge and another with central suction and peripheral discharge structured on a system that allows the preservation of a liquid piston to the extension of the mechanical piston, the system, in its turn, being composed of two devices: 1) a guiding device for the removal of gases, having a tubular distribution chamber with a cavity structured in a lower part with the role of connection with the mechanical pump and an upper part, which is the guiding device proper, the upper part being located above the level of the working chamber having the upper surface strictly limited to the lower surfaces of two concentric valves, one central conical and the other annular peripheral; and 2) a compensation device for the completion of the liquid piston with the role of air-liquid separator, consisting of a suction chamber and a discharge chamber vertically arranged in the extension of the guiding device, connected with the base of the cavities to the peak of guide cavity by means of valves, both the suction orifice and the discharge orifice being located on the dome of the related chambers.

None of the above mentioned solutions has provided a marine engine or propulsor that does not have any moving metallic parts.

SUMMARY

Aspects of the present disclosure provide a marine vessel engine that is used for the propulsion of marine vessels without having any moving metallic parts in such engine.

Aspects of the present disclosure provide a marine vessel engine in which the piston is formed from water.

Aspects of the present disclosure provide a marine vessel engine which does not need any lubrication or cooling.

Aspects of the present disclosure provide a marine vessel engine that is connected to the body of the marine vessel by a hinge.

Aspects of the present disclosure provide a marine vessel engine that can be rotated about the hinge to facilitate the steering of the marine vessel.

Aspects of the present disclosure provide a marine vessel engine comprising a cylinder, a bent tube with a plurality of openings and two ends, a flapping member installed on one of the bent tube ends, at least one solenoid valve, and an exhaust. Also, the marine vessel engine of the present disclosure may have at least one spark plug.

In aspects of the present disclosure, a water column is filled in a cylinder through bent tube openings and is purged outside the cylinder via a flapping member.

In aspects of the present disclosure, at least one solenoid valve controls the flow of a power source into the cylinder.

In aspects of the present disclosure, a cylinder has a decreasing cross-sectional area as moving downward.

In aspects of the present disclosure, a cylinder has an airfoil shape when looking at such cylinder from an elevated position.

In aspects of the present disclosure, a bent tube is connected from the other end to the end of the cylinder that has the smaller cross-section.

In aspects of the present disclosure, a bent tube is bent in an angle of about 90 degrees, wherein the cross-sectional area of such tube is less than a cross-sectional area of the cylinder.

In aspects of the present disclosure, the number of cylinders found in the engine depends on the size of the vessel as well as the desired thrust force.

BRIEF DESCRIPTION OF THE DRAWINGS

Aspects of the present disclosure will now be described with reference to the following drawings without restricting the scope thereof, and in which.

DETAILED DESCRIPTION

Within FIGS. 1, 2A, 2B, 3, and 4, the straight dashed lines represent approximately where the water line would reside during operation of the marine vessel engine in a body of water (which is represented by the wavy line in FIGS. 2A, 2B, 4A, and 4B).

Figure 1:
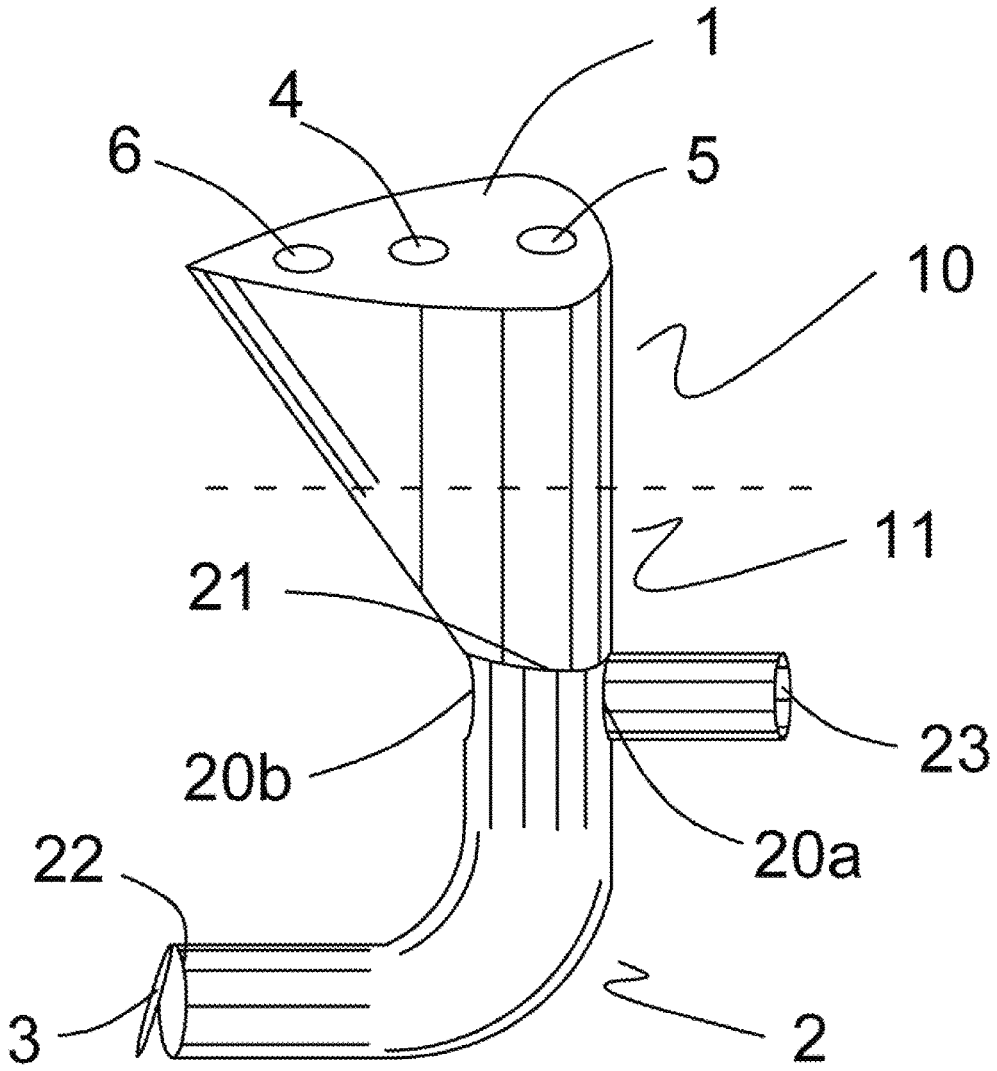
FIG. 1 illustrates a perspective view of a marine vessel engine cylinder configured according to embodiments of the present disclosure.
Figure 2A:
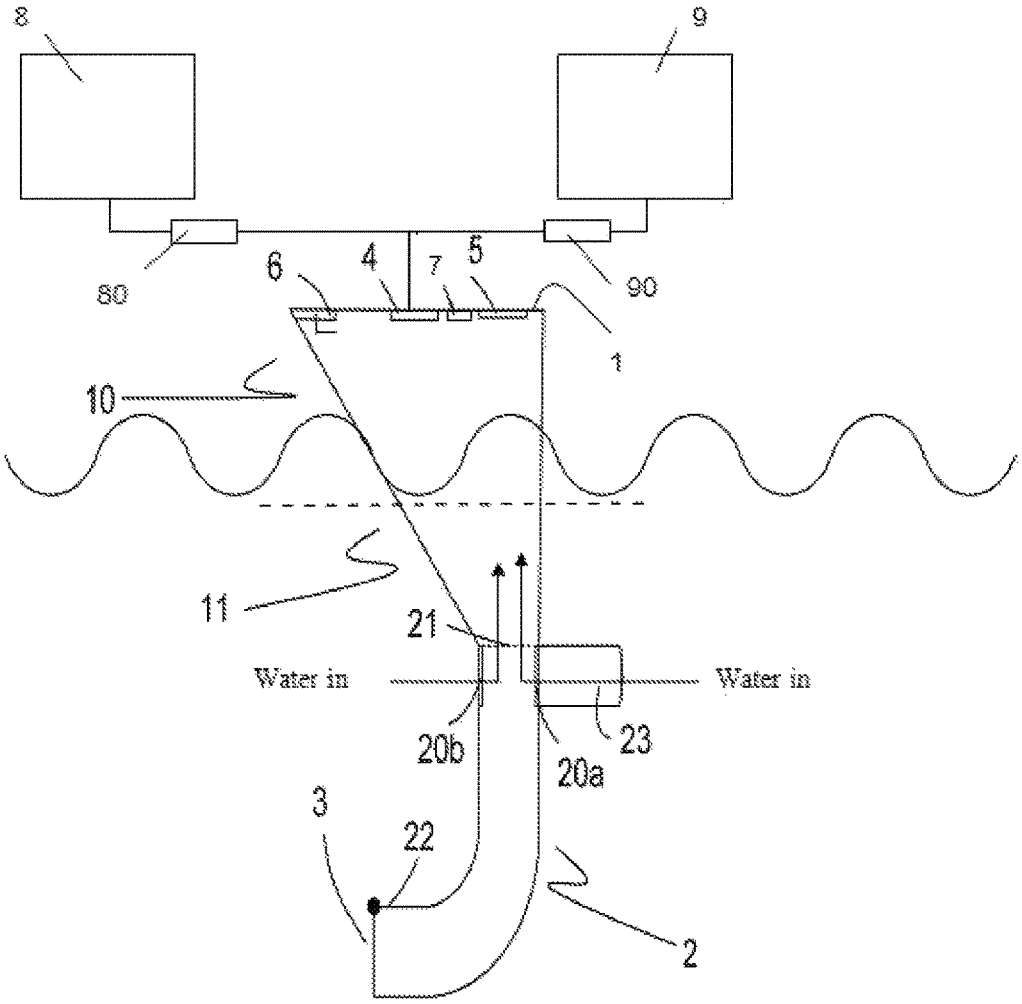
FIG. 2A illustrates a cross-sectional view of the marine vessel engine cylinder illustrated in FIG. 1, taken parallel to the longitudinal direction of such engine, showing a water intake process.
Figure 2B:
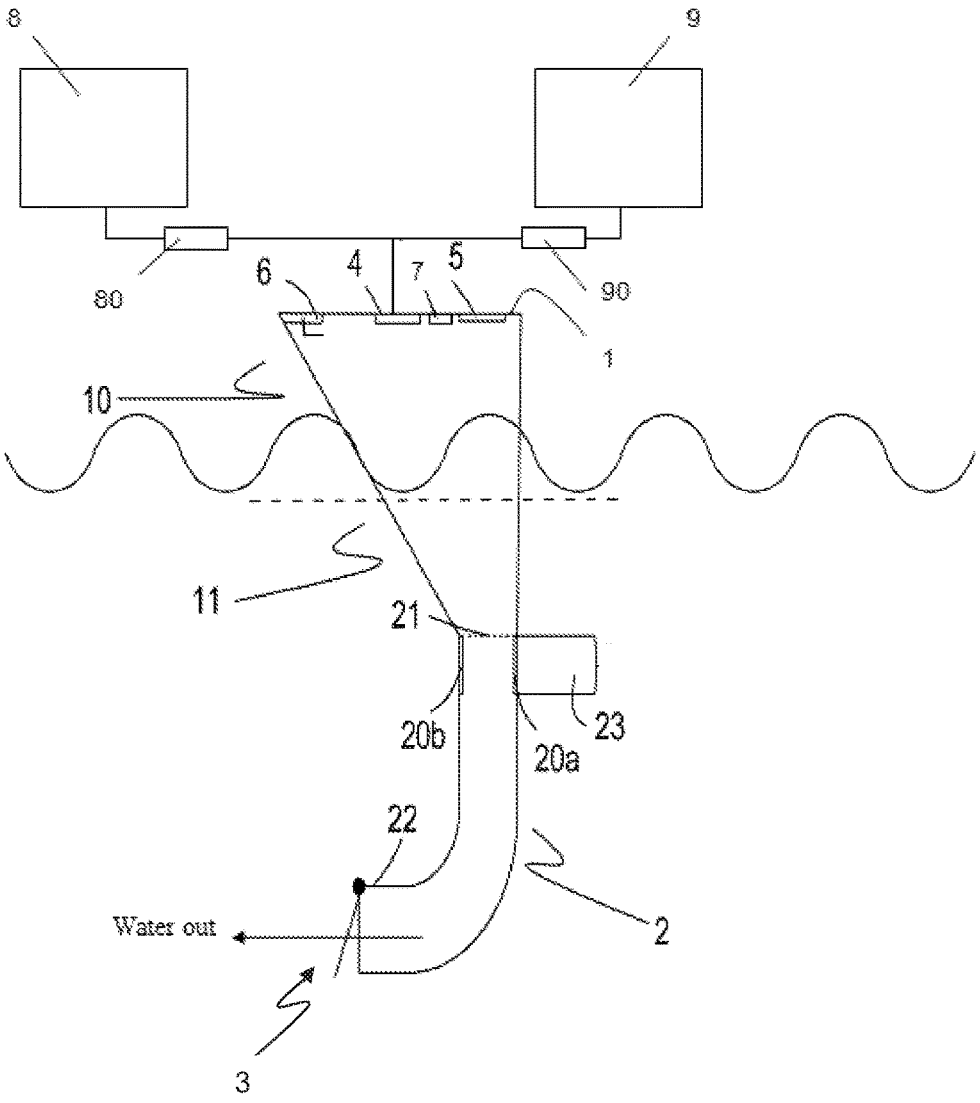
FIG. 2B illustrates a cross-sectional view of the marine vessel engine cylinder illustrated in FIG. 1, taken parallel to the longitudinal direction of such engine, showing a water purging process.

FIGS. 1, 2A, and 2B illustrate a marine vessel engine configured according to embodiments of the present disclosure. The marine vessel engine comprises at least one cylinder 1; at least one bent tube 2 with one or more openings 20*a* and/or 20*b*, and two ends 21 and 22; at least one flapping member 3; a plurality of solenoid valves 4, 80, and 90; at least one exhaust 5; and at least a spark plug 6. The cylinder 1 has an upper portion 10 and a lower portion 11 with a decreasing cross-sectional area as moving downward from the upper portion 10 towards the lower portion 11, wherein such reduction in the cross-sectional area reduces the losses associated with the combustion process.

The marine vessel engine according to embodiments may be partially submerged in water.

In embodiments of the present disclosure, a power source for the engine comprises a fuel (e.g., combustible) mixed with air. The fuel may be contained in a fuel reservoir 8, and the air may be contained in an air tank 9 or obtained from the surrounding environment, wherein the solenoid valves 80 and/or 90 control the flow of the fuel and air to the cylinder 1, respectively.

In embodiments of the present disclosure, one of the bent tube ends 21 is connected to the lower portion 11 of the cylinder 1, while the other end 22 is connected to the flapping member 3, wherein such flapping member 3 may comprise a disc that is angularly displaced under force exerted by water moving outside the engine through the end 22 of the bent tube 2.

In embodiments of the present disclosure, the one or more openings 20*a* and/or 20*b* are positioned in proximity to the end 21 of the bent tube 2, wherein each of such one or more openings 20*a* and/or 20*b* may have a reed valve (not shown), or an equivalent valve-like apparatus. Reed valves are known in the art, and are one-way check valves comprising thin metal strips, wherein such valves are normally positioned on openings found in walls to restrict the flow of a fluid to a single direction by opening and closing under changing pressure on each face of the strips.

In embodiments of the present disclosure, the solenoid valve 4, exhaust 5, and spark plug 6 are positioned in proximity to the upper portion 10 of the cylinder 1.

In embodiments of the present disclosure, a water column that fills the cylinder 1 acts as a piston of the marine vessel engine.

According to embodiments of the present disclosure, the bent tube 2 may have a bending angle of about 90 degrees, wherein the end 22 of such bent tube 2 points to an opposite direction of the intended motion of the marine vessel.

Initially, the pressure inside the cylinder 1 has a value approximately that of the atmospheric pressure surrounding the marine vessel. Therefore, water from the surrounding body of water enters the engine through the one or more openings 20*a* and/or 20*b* via the reed valves. A tube 23 may be connected to the opening 20*a* such that it extends towards the direction of motion of the marine vessel, wherein such tube 23 acts to reduce the rise time of the water inside the cylinder 1 as the water rushes in through the tube 23 as the marine vessel moves forward through the body of water.

Figure 9:
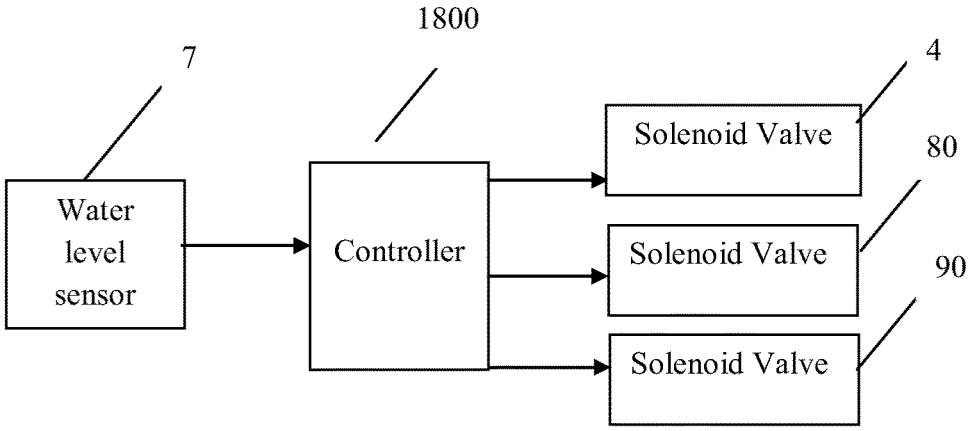
FIG. 9 illustrates a block diagram showing a flow of data during control of a marine vessel engine containing a cylinder, such as illustrated in FIG. 1 during a water intake process.

Then, as the water level increases inside the cylinder 1, the pressure inside the cylinder 1 will increase until both the level of water and the pressure inside the cylinder 1 become equal to the water level and the water pressure in the surrounding body of water. When the equality in pressure and level is achieved, the reed valves at the one or more openings 20*a* and/or 20*b* close. The closure of the reed valves is automatically achieved by the dynamic pressure of water coming through the tube 23 when the vessel is moving forward in water. After that, the solenoid valves 4, 80, and 90 open pre-calibrated amounts in order to let a predetermined amount of fuel mixed with air to enter the cylinder 1, wherein such pre-calibrated amounts vary depending on a desired thrust from the engine. At about the same time, the spark plug 6 ignites a spark in order to cause an explosion inside the cylinder 1 by igniting the fuel/air mixture. The exhaust 5 may include a solenoid valve that opens and closes in response to control signals received from a microcontroller 1800 (see FIG. 9). The microcontroller 1800 may be programmed to send signals to open the exhaust solenoid valve just after the water purging cycle ends (exhaust cycle).

As a result of the explosion, the water column inside the cylinder 1 is propelled outside the engine through the end 22 of the bent tube 2 via the flapping member 3 to the surrounding water, thus producing a propulsion force that causes the marine vessel engine to move in an opposite direction of the propelled water. The exhaust gases resulting from the explosion are purged outside the cylinder 1 through the exhaust 5. After that, the pressure inside the cylinder 1 decreases again to a value close to the atmospheric pressure, and the process is repeated.

In embodiments of the present disclosure, the opening and closing of the solenoid valve 4 may be controlled by the microcontroller 1800.

A water level sensor 7 may be added to each cylinder in the embodiments of the present disclosure, wherein such sensor 7 provides a feedback to the microcontroller 1800 (see FIG. 9) about the water level inside the cylinder 1 in order to control the opening and closing of the solenoid valves 4, 80, and 90. The solenoid valve 4 may be configured to open when the water level reaches a predetermined water level, which makes the cylinder 1 ready for the next power stroke.

In embodiments of the present disclosure, the ratio of the cylinder 1 maximum diameter at the upper portion 10 to the bent tube 2 diameter is predetermined. The ratio may be 10:1, 20:1 or 30:1, and can change according to the desired thrust from the engine.

In embodiments of the present disclosure, the cylinder 1 has a top view with a shape of an air foil, as can be seen in FIG. 1.

The number of cylinders implemented in the marine vessel engine may depend on the desired thrust power, wherein two or more cylinders may be configured parallel to each other with a predetermined displacement between each two consecutive cylinders, wherein such displacement reduces the drag force and thus increases the thrust power of the marine vessel engine.

Figure 7:
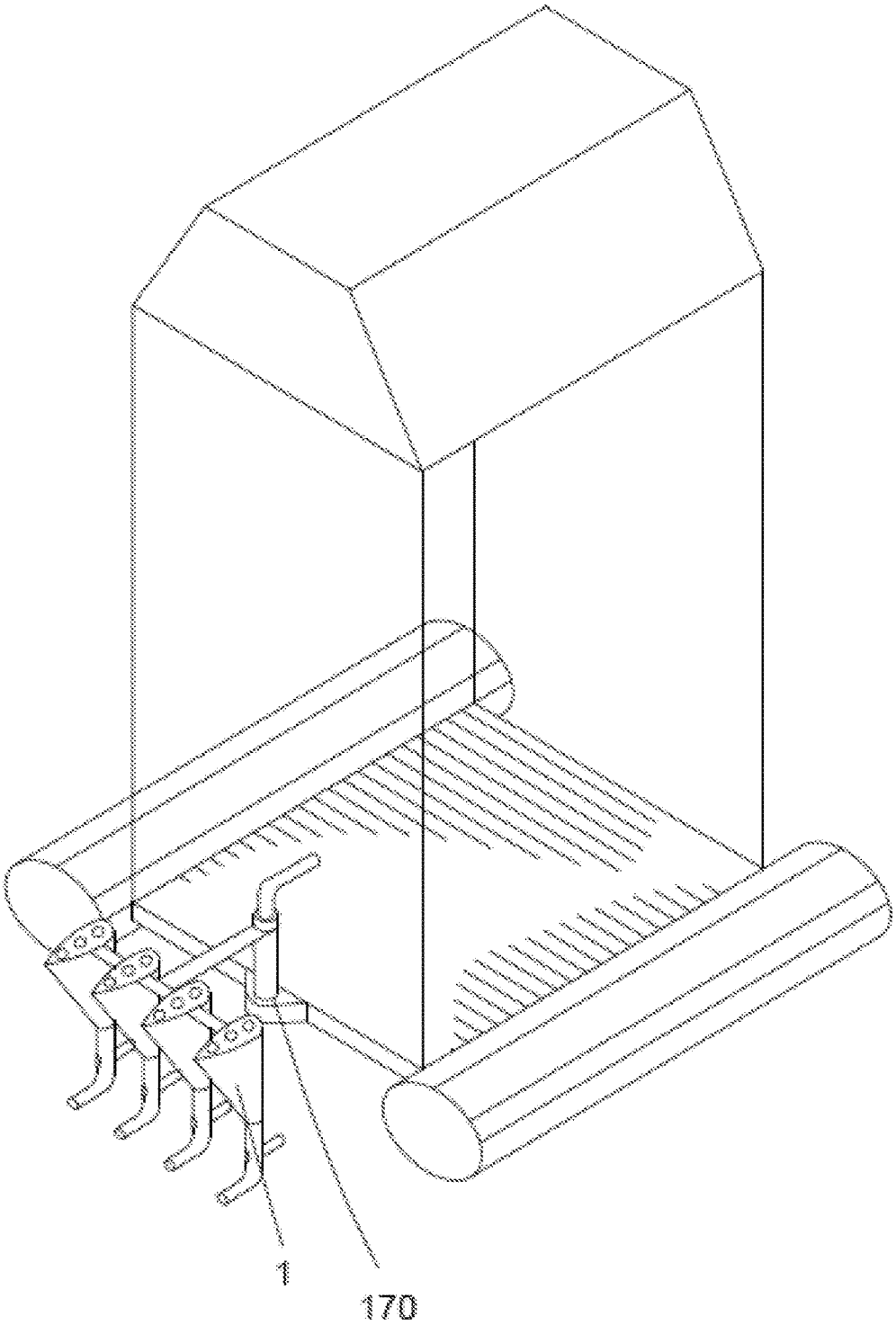
FIG. 7 illustrates a marine vessel engine connected to a marine vessel comprising a plurality of cylinders, such as illustrated in FIGS. 1 and 5.

In embodiments of the present disclosure, one or more engines are connected to a marine vessel by a hinged connection 170 (see FIG. 7), wherein such hinged connection 170 enables steering of the marine vessel by pivoting such engine(s) to the left or right about the hinged connection relative to the vessel body. The hinged connection 170 also enables any desired reduction in speed or any desired stopping of the vessel through reversing the thrust, wherein such reversal of the thrust is achieved by pivoting the engine(s) about the hinged connection such that the water jet substantially acts in a direction of the vessel's motion.

Figure 3:
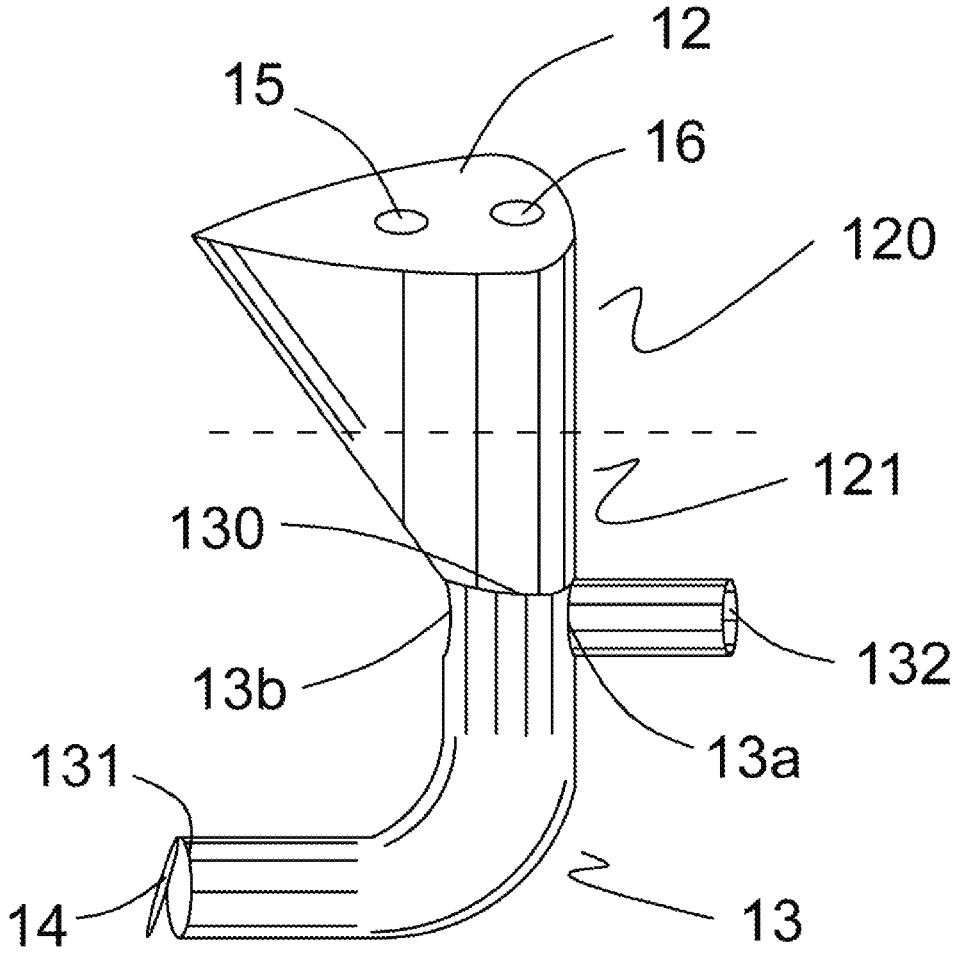
FIG. 3 illustrates a perspective view of the marine vessel engine cylinder configured according to embodiments of the present disclosure.
Figure 4A:
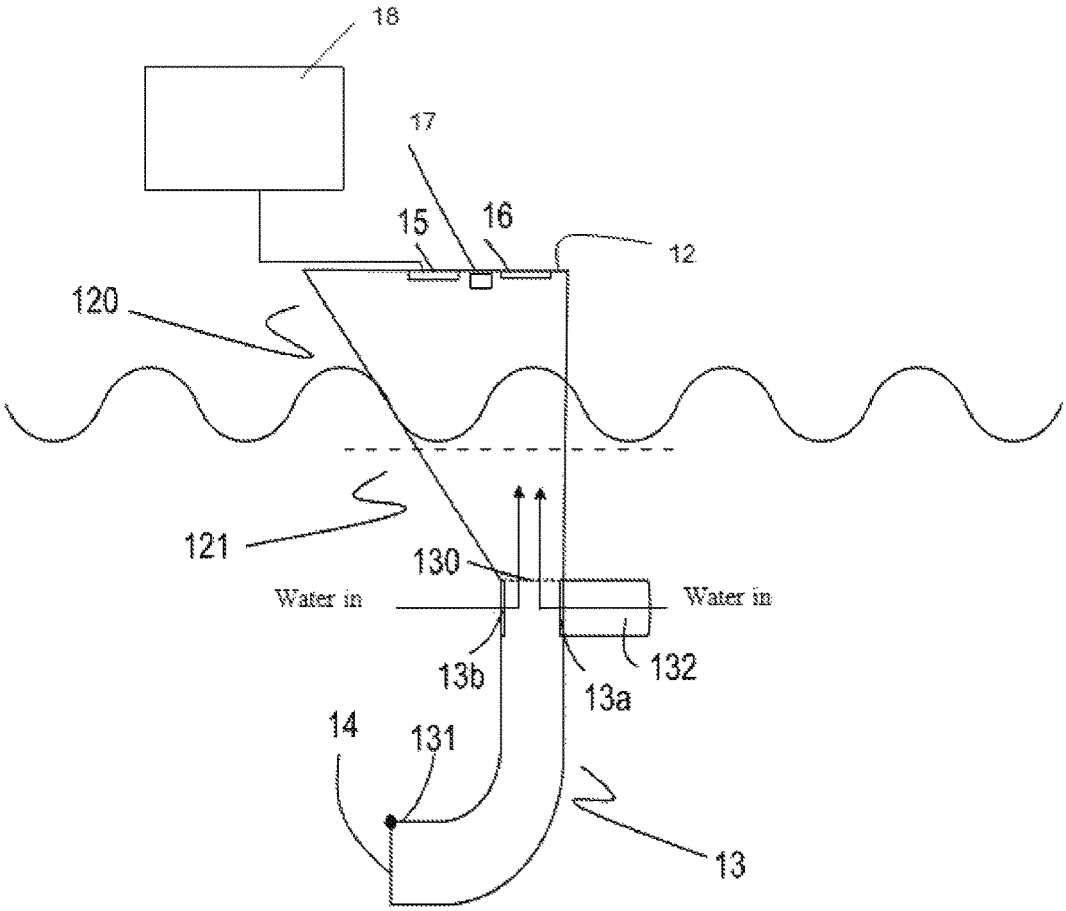
FIG. 4A illustrates a cross-sectional view of the marine vessel engine cylinder illustrated in FIG. 3, taken parallel to the longitudinal direction of such engine, showing a water intake process.
Figure 4B:
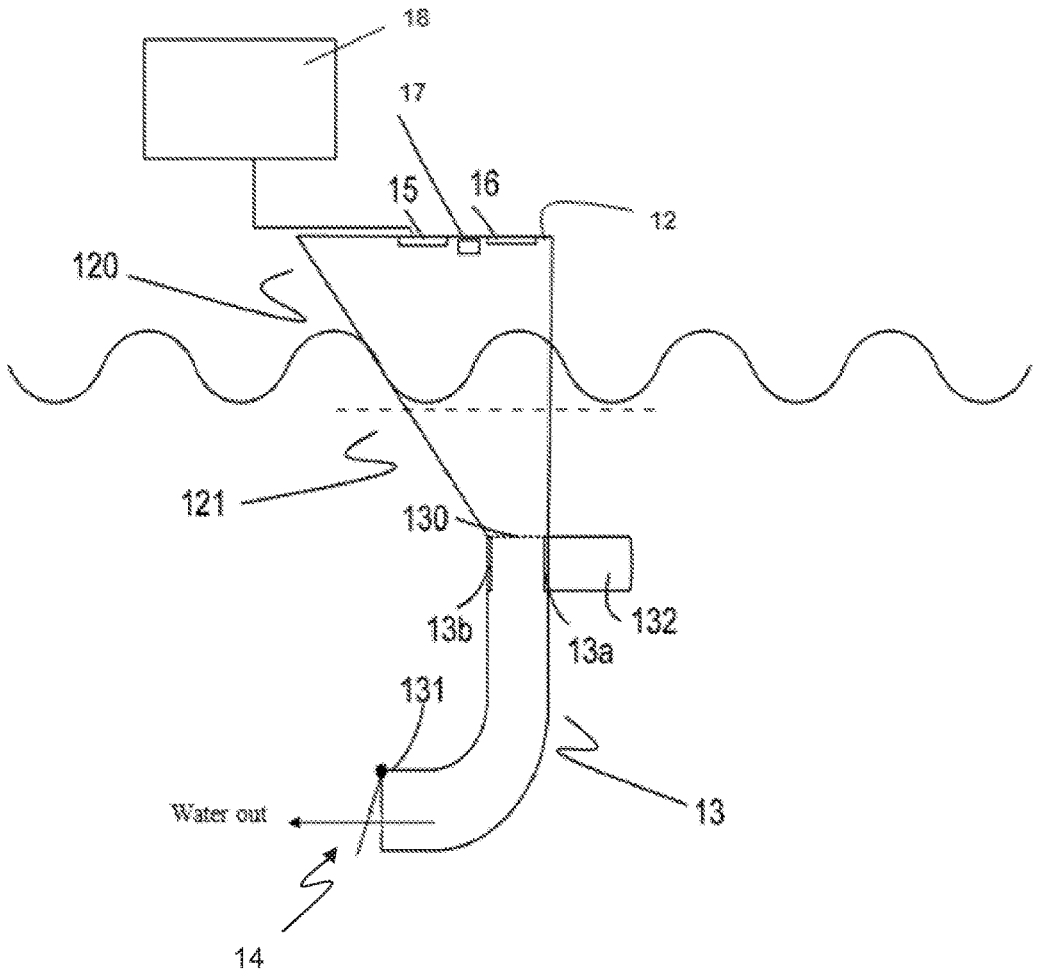
FIG. 4B illustrates a cross-sectional view of the marine vessel engine cylinder illustrated in FIG. 3, taken parallel to the longitudinal direction of such engine, showing a water purging process.

FIGS. 3, 4A, and 4B illustrate embodiments of the present disclosure comprising at least one cylinder 12; at least one bent tube 13 with one or more openings 13*a* and/or 13*b*, and two ends 130 and 131; at least one flapping member 14; at least one solenoid valve 15; and at least an exhaust 16. The cylinder 12 has an upper portion 120 and a lower portion 121 with a decreasing cross-sectional area as moving downward from the upper portion 120 towards the lower portion 121, wherein such reduction in the cross-sectional area reduces the losses.

Figure 5:
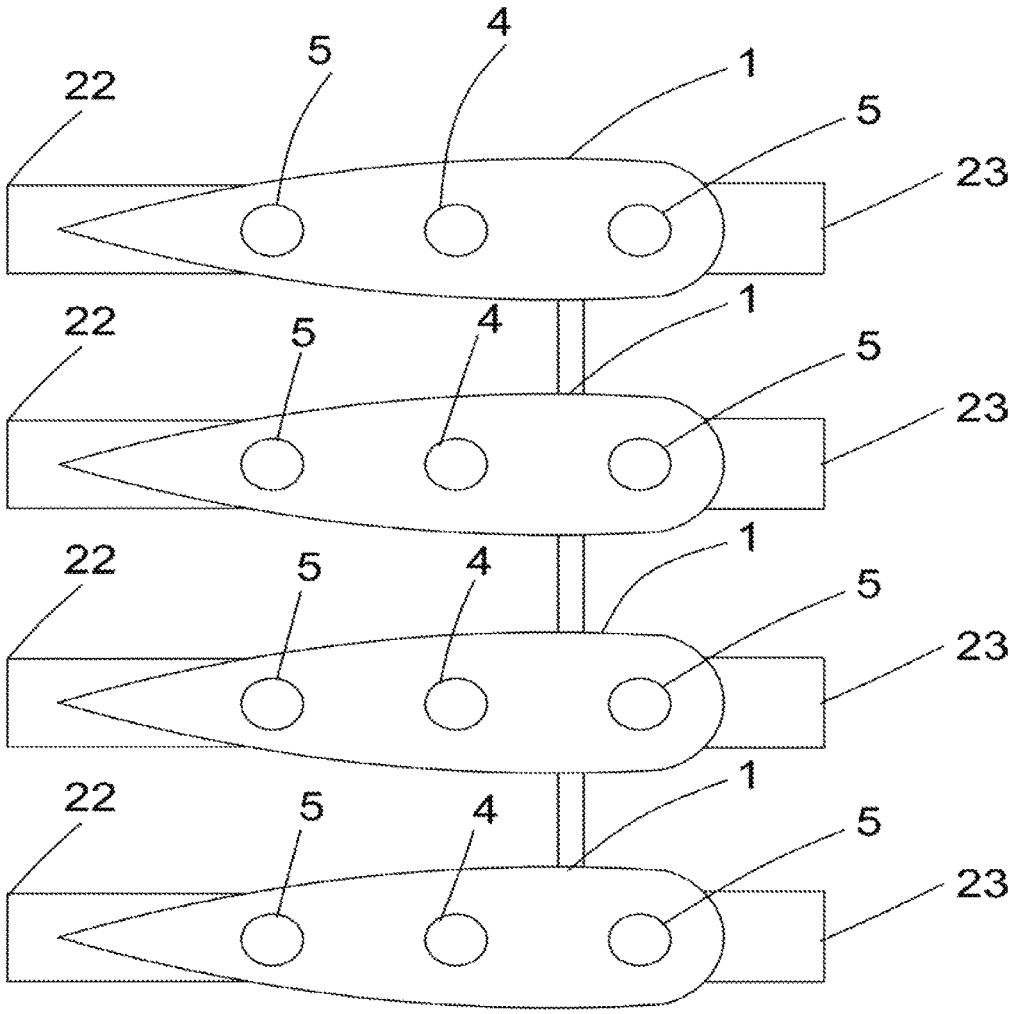
FIG. 5 illustrates a top view of a plurality of coupled marine vessel engine cylinders, such as illustrated in FIG. 1.
Figure 6:
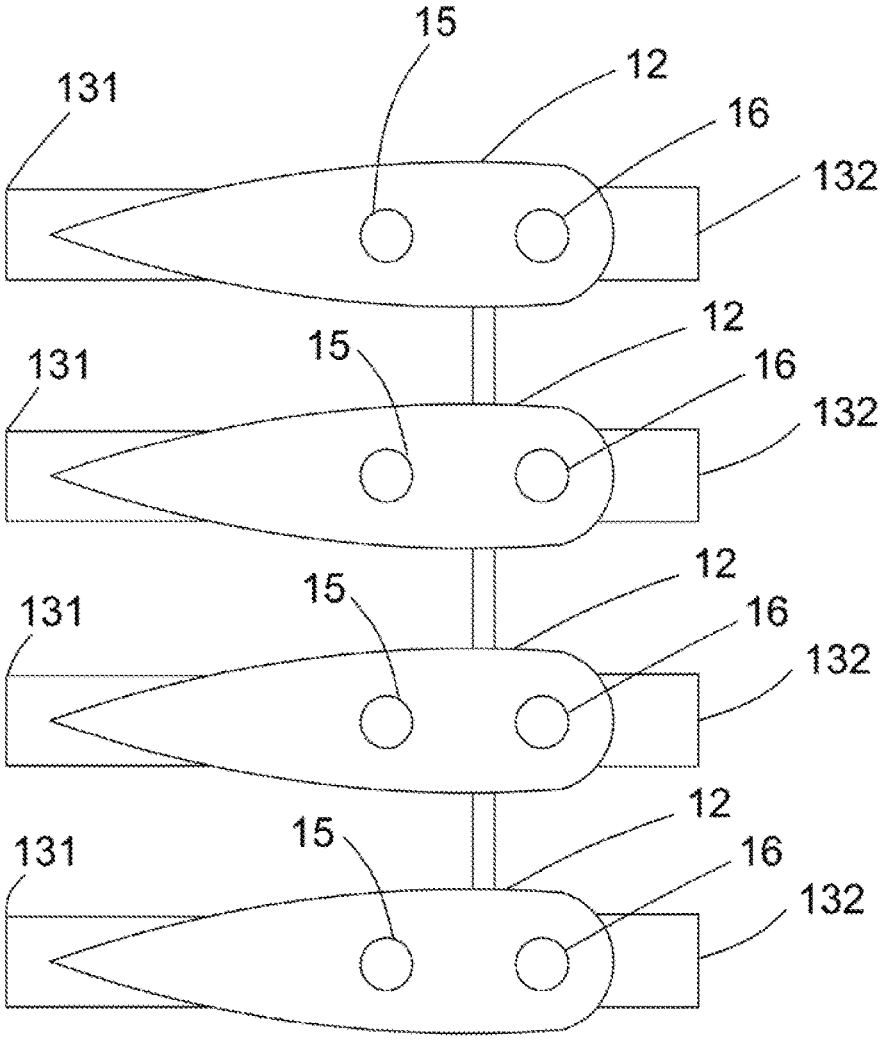
FIG. 6 illustrates a top view of a plurality of coupled marine vessel engine cylinders, such as illustrated in FIG. 3.

FIGS. 5-6 illustrate top views of a marine vessel engine configured in accordance with embodiments of the present disclosure, wherein the engine comprises a plurality of cylinders as shown in FIGS. 1 and 3, respectively.

According to embodiments of the present disclosure as illustrated in FIGS. 3, 4A, and 4B, the power source for the engine may comprise a compressed gas, such as compressed air.

In embodiments of the present disclosure, one of the bent tube ends 130 is connected to the lower portion 121 of the cylinder 12, while the other end 131 is connected to the flapping member 14, which may be similar to the flapping member 3.

In embodiments of the present disclosure, the one or more openings 13*a* and/or 13*b* are positioned in proximity to the end 130 of the bent tube 13, wherein each of such one or more openings 13*a* and/or 13*b* has a reed valve, or an equivalent valve-like apparatus.

In embodiments of the present disclosure, the solenoid valve 15 and the exhaust 16 are positioned in proximity to the upper portion 120 of the cylinder 12.

In embodiments of the present disclosure, a water column that fills the cylinder 12 acts as the piston of the marine vessel engine.

According to embodiments of the present disclosure, the bent tube 13 has a bending angle of about 90 degrees, wherein the end 131 of such bent tube 13 points to an opposite direction of the intended motion of the marine vessel.

Initially, the pressure inside the cylinder 12 has a value approximately that of the atmospheric pressure surrounding the marine vessel. Therefore, water from the surrounding body of water enters the engine through one or more openings 13*a* and/or 13*b* via the reed valves. A tube 132 may be connected to the opening 13*a* such that it extends towards the direction of motion of the marine vessel, wherein such tube 132 acts to reduce the rise time of the water inside the cylinder 12 as the water rushes in through the tube 132 as the marine vessel moves forward through the body of water.

Figure 8:
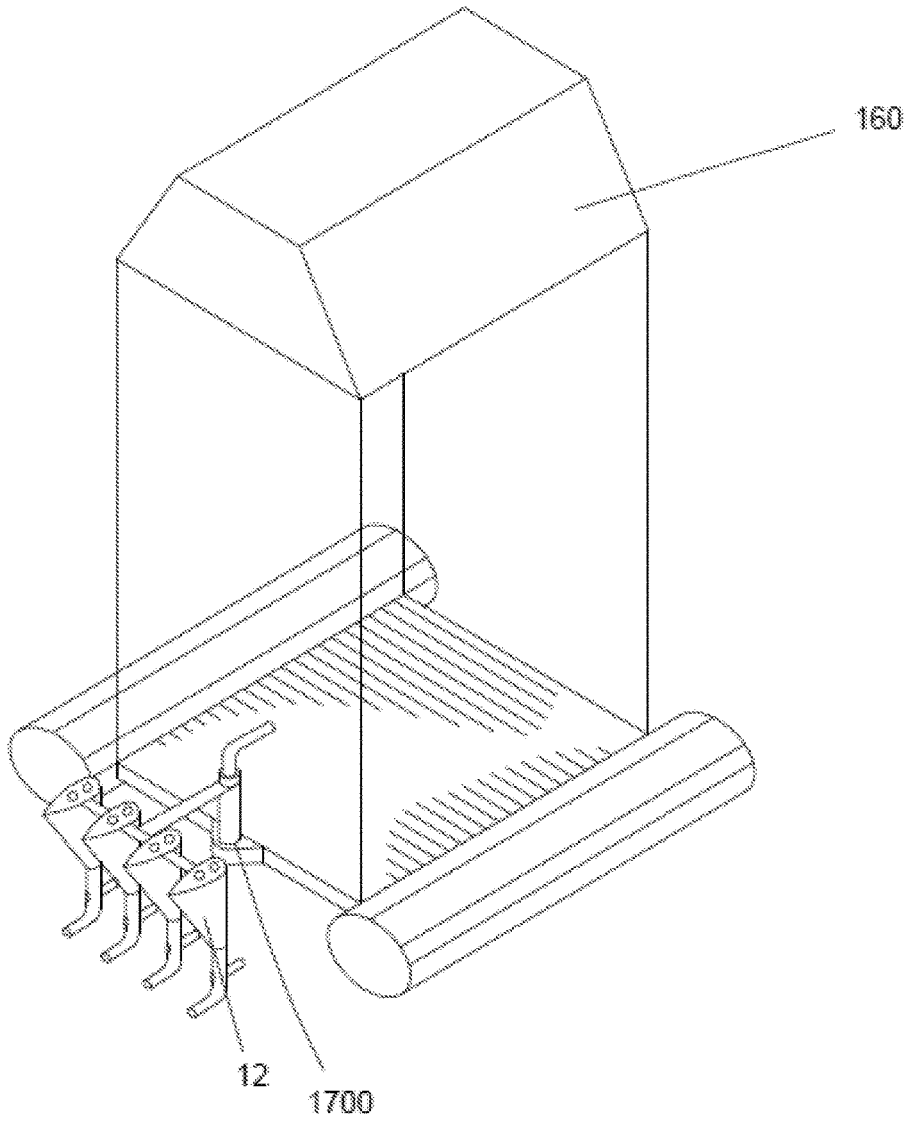
FIG. 8 illustrates a marine vessel engine connected to a marine vessel comprising a plurality of cylinders, such as illustrated in FIGS. 3 and 6.

Then, as the water level inside the cylinder 12 increases, the pressure inside the cylinder 12 will increase until both the level of water and the pressure inside the cylinder 12 become equal to the water level and the water pressure in the surrounding body of water. When the equality in pressure and level is achieved, the reed valves close at the one or more openings 13*a* and/or 13*b*. After that, the solenoid valve 15 opens a pre-calibrated amount in order to let a predetermined amount of compressed air enclosed in an air tank 18 to be purged into the cylinder 12. The marine vessel may be initially charged with compressed air at the dock, and/or supplemented by an air compressor on board whose electric power may be taken from solar panels mounted on the top 160 of the vessel (see FIG. 8).

As a result of the purge of the compressed air into the cylinder 12, the water column inside the cylinder 12 is propelled through the end 131 of the bent tube 13 to the surrounding water, thus producing a propulsion force that causes the marine vessel engine to move in an opposite direction of the propelled water. The exhaust gases resulting from the expansion may be purged outside the cylinder 12 through the exhaust 16. After that, the pressure inside the cylinder 12 decreases again to a value close to the atmospheric pressure, and the process is repeated. The exhaust 16 may include a solenoid valve that opens and closes in response to control signals received from the microcontroller 1800. The microcontroller 1800 may be programmed to send signals to open the exhaust solenoid valve just after the water purging cycle ends (exhaust cycle).

In embodiments of the present disclosure, the opening and closing of the solenoid valve 15 may be controlled by a microcontroller 1900.

Figure 11:
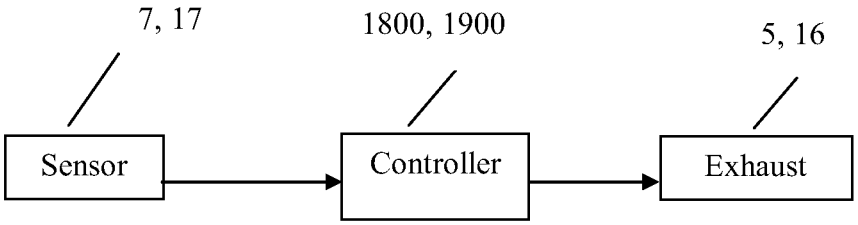
FIG. 11 illustrates a block diagram showing a flow of data during a control of a marine vessel engine containing a cylinder, such as illustrated in FIGS. 1 and 3 during an exhaust process.

In embodiments of the present disclosure, the exhaust valves 5, 16 may be operated by the microcontrollers 1800, 1900 (see FIG. 11).

Figure 10:
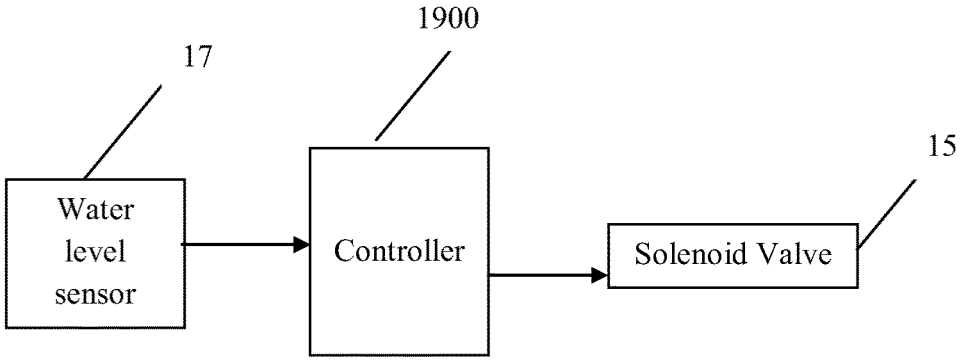
FIG. 10 illustrates a block diagram showing a flow of data during control of a marine vessel engine containing a cylinder, such as illustrated in FIG. 3 during a water intake process.

A water level sensor 17 may be added to each cylinder in embodiments of the present invention, wherein such sensor provides a feedback, such as to a microcontroller 1900 (see FIG. 10), about the water level inside the cylinder in order to control the opening and closing of the solenoid valve. The solenoid valve opens when the water level reaches a predetermined water level, which makes the cylinder ready for the next power stroke.

In embodiments of the present disclosure, the ratio of the cylinder 12 maximum diameter at the upper portion 120 to the bent tube 13 diameter is predetermined. The ratio may be 10:1, 20:1 or 30:1, and can change according to the desired thrust from the engine.

In embodiments of the present disclosure, the cylinder 12 has a top view with a shape of an air foil.

The number of cylinders implemented in the marine vessel engine may depend on the desired thrust power, wherein two or more cylinders may be configured parallel to each other with a predetermined displacement between each two consecutive cylinders, wherein such displacement reduces the drag force and thus increases the thrust power of the marine vessel engine.

In embodiments of the present disclosure, the engine is connected to a marine vessel by a hinged connection 1700 (see FIG. 8), wherein such hinged connection enables steering of the marine vessel by pivoting such engine to the left or right about the hinged connection relative to the vessel body. The hinged connection 1700 also enables any desired reduction in speed or any desired stopping of the vessel through reversing the thrust, wherein such reversal of the thrust is achieved by pivoting the engine about the hinged 1700 connection such that the water jet substantially acts in a direction of the vessel's motion.

In embodiments of the present disclosure, a valve can be installed at the bent tube end 131, wherein such valve can be operated by a pneumatic motor. The valve opens to allow water to pass through the tube end 131 during the water filling process in order to reduce the rise time.

While the invention has been described in details and with reference to specific embodiments thereof, it will be apparent to one skilled in the art that various additions, omissions, and modifications can be made without departing from the spirit and scope thereof.

Although the above description contains much specificity, these should not be construed as limitations on the scope of the invention but is merely representative of the embodiments of this invention. The embodiments of the invention described above are intended to be exemplary only.

As used herein, the singular forms "a," "an," and "the" include plural referents unless the context clearly dictates otherwise.

As used herein with respect to an identified property or circumstance, "substantially" refers to a degree of deviation that is sufficiently small so as to not measurably detract from the identified property or circumstance. The exact degree of deviation allowable may in some cases depend on the specific context.

As used herein, the term "about," when referring to a value or to an amount of mass, weight, time, volume, concentration or percentage is meant to encompass variations of in some embodiments ±20%, in some embodiments ±10%, in some embodiments ±5%, in some embodiments ±1%, in some embodiments ±0.5%, and in some embodiments ±0.1% from the specified amount, as such variations are appropriate to perform the disclosed method.

As used herein, "significance" or "significant" relates to a statistical analysis of the probability that there is a non-random association between two or more entities. To determine whether or not a relationship is "significant" or has "significance," statistical manipulations of the data can be performed to calculate a probability, expressed as a "p value." Those p values that fall below a user-defined cutoff point are regarded as significant. In some embodiments, a p value less than or equal to 0.05, in some embodiments less than 0.01, in some embodiments less than 0.005, and in some embodiments less than 0.001, are regarded as significant. Accordingly, a p value greater than or equal to 0.05 is considered not significant.

As used herein, the term "and/or" when used in the context of a listing of entities, refers to the entities being present singly or in combination. Thus, for example, the phrase "A, B, C, and/or D" includes A, B, C, and D individually, but also includes any and all combinations and subcombinations of A, B, C, and D. The term "comprising," which is synonymous with "including," "containing," or "characterized by," is inclusive or open-ended and does not exclude additional, unrecited elements or method steps. "Comprising" is a term of art used in claim language which means that the named elements are present, but other elements can be added and still form a construct or method within the scope of the claim.

As used herein, "adjacent" refers to the proximity of two structures or elements. Particularly, elements that are identified as being "adjacent" may be either abutting or connected. Such elements may also be near or close to each other without necessarily contacting each other. The exact degree of proximity may in some cases depend on the specific context.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a defacto equivalent of any other member of the same list solely based on their presentation in a common group without indications to the contrary.

Any steps recited in any method or process claims may be executed in any order and are not limited to the order presented in the claims. Means-plus-function or step-plus function limitations will only be employed where for a specific claim limitation all of the following conditions are present in that limitation: a) "means for" or "step for" is expressly recited; and b) a corresponding function is expressly recited. The structure, material or acts that support the means-plus function are expressly recited in the description herein. Accordingly, the scope of the invention should be determined solely by the appended claims and their legal equivalents, rather than by the descriptions and examples given herein.

The invention claimed is:

1. A marine vessel engine configured to utilize a water column acting as a piston and configured to utilize fuel mixed with air as a power source, the marine vessel engine comprising:

a cylinder with an upper portion and a lower portion;

a hollow bent tube having two ends and one or more openings, wherein a first end of the two ends is coupled to the lower portion of the cylinder, and wherein the one or more openings is configured to intake a water column into the cylinder;

a valve in proximity to the upper portion of the cylinder, the valve configured to control a flow of the fuel mixed with air into the cylinder and adjacent the water column; and a spark plug configured to ignite the fuel mixed with air.

2. The marine vessel engine of claim 1, wherein the cylinder has a decreasing cross-sectional area as moving vertically downward from the upper portion to the lower portion.

3. The marine vessel engine of claim 1, wherein hollow the bent tube has a bending angle of about 90 degrees.

4. The marine vessel engine of claim 1, wherein the two ends of the hollow bent tube comprise an upper end and a lower end.

5. The marine vessel engine of claim 4, wherein at least one of the one or more openings has a reed valve, which is positioned in proximity to the bent tube upper end.

6. The marine vessel engine of claim 5, wherein at least one of the one or more openings has a tube extending towards a direction of motion of the marine vessel engine.

7. The marine vessel engine of claim 1, further comprising a flapping member connected to a second end of the two ends of the bent tube.

8. The marine vessel engine of claim 7, wherein the cylinder is configured so that the water column enters the cylinder from the one or more openings and exits the engine through the flapping member.

9. The marine vessel engine of claim 1, wherein the cylinder is configured so that air is purged inside the cylinder through an exhaust to improve volumetric efficiency of the marine vessel engine.

10. The marine vessel engine of claim 1, wherein further comprising a water level sensor configured to detect a water level inside the cylinder.

11. A marine vessel engine configured to utilize a water column acting as a piston and configured to utilize compressed air as a power source, the marine vessel engine comprising:

a cylinder with an upper portion and a lower portion;

a bent tube having two ends and one or more openings, wherein a first end of the two ends is coupled to the lower portion of the cylinder, and wherein the one or more openings is configured to intake a water column into the cylinder;

a valve configured to control a flow of the compressed air into the cylinder adjacent the water column.

12. The marine vessel engine of claim 11, wherein the cylinder has a decreasing cross-sectional area as vertically moving downward from the upper portion to the lower portion.

13. The marine vessel engine of claim 11, wherein the bent tube has a bending angle of about 90 degrees.

14. The marine vessel engine of claim 11, wherein the two ends of the bent tube comprise an upper end and a lower end.

15. The marine vessel engine of claim 14, wherein at least one of the one or more openings has a reed valve, which is positioned in proximity to the bent tube upper end.

16. The marine vessel engine of claim 11, wherein at least one of the one or more openings has a tube extending towards a direction of intended motion of the marine vessel engine.

17. The marine vessel engine of claim 11, further comprising a flapping member connected to a second end of the two ends of the bent tube.

18. The marine vessel engine of claim 17, wherein the cylinder is configured so that the water column enters the cylinder from the one or more openings and exits the engine through the flapping member.

19. The marine vessel engine of claim 18, further comprising a valve controlled by a pneumatic motor and coupled to the flapping member.

20. The marine vessel engine of claim 11, further comprising a water level sensor configured to detect a water level inside the cylinder.

* * * * *